US006478217B1

(12) United States Patent
Lombardi et al.

(10) Patent No.: US 6,478,217 B1
(45) Date of Patent: Nov. 12, 2002

(54) GIFT OR SET BOX

(75) Inventors: Michael Henry Lombardi, Stamford, CT (US); Patricia Ann Strenkert, New City, NY (US)

(73) Assignee: Conopco, Inc., New York, NY (US)

( * ) Notice: Subject to any disclaimer, the term of this patent is extended or adjusted under 35 U.S.C. 154(b) by 0 days.

(21) Appl. No.: 09/729,891

(22) Filed: Dec. 5, 2000

Related U.S. Application Data

(60) Provisional application No. 60/211,257, filed on Jun. 13, 2000.

(51) Int. Cl.[7] ..... B65D 5/24

(52) U.S. Cl. ..... 229/122.34; 229/125.19; 229/165; 229/186

(58) Field of Search ..... 229/122.32, 122.34, 229/125.19, 165, 182, 186

(56) References Cited

U.S. PATENT DOCUMENTS

| | | | | |
|---|---|---|---|---|
| 1,758,512 A | | 5/1930 | Gross | |
| 1,833,492 A | * | 11/1931 | Miller | 229/186 |
| 1,850,164 A | | 3/1932 | Andrews | |
| 1,928,297 A | | 9/1933 | Mabee | |
| 1,957,264 A | | 5/1934 | Gross | |
| 1,988,453 A | | 1/1935 | Knowlton | |
| 2,004,197 A | | 6/1935 | Ethridge | |
| 2,028,276 A | * | 1/1936 | Evans | 229/122.34 |
| 2,079,087 A | | 5/1937 | Schmidt | |
| 2,084,965 A | | 6/1937 | Wolf | |
| 2,090,780 A | | 8/1937 | Bonville | |
| 2,105,373 A | | 1/1938 | Ritter | |
| 2,117,502 A | | 5/1938 | Reich | |
| 2,769,588 A | | 11/1956 | Beck | |
| 2,783,932 A | | 3/1957 | Frankenstein | |
| 3,136,473 A | | 6/1964 | Kieffer | |
| 3,598,233 A | | 8/1971 | Jasinover | |
| 3,797,727 A | | 3/1974 | Downing et al. | |
| 4,380,314 A | * | 4/1983 | Langston, Jr. et al. | 229/182 |
| 4,391,405 A | | 7/1983 | Drinon | |
| 4,953,779 A | * | 9/1990 | Densen | 229/125.19 |
| 5,215,248 A | * | 6/1993 | Moser | 229/122.32 |
| 5,294,040 A | * | 3/1994 | Cohen et al. | 229/186 |

FOREIGN PATENT DOCUMENTS

| | | |
|---|---|---|
| DE | 74 34 496 | 6/1976 |

OTHER PUBLICATIONS

The Wiley Encyclopedia of Packaging Technology, John Wiley & Sons (1986), p. 67.*

* cited by examiner

*Primary Examiner*—Gary E. Elkins
(74) *Attorney, Agent, or Firm*—Milton L. Honig

(57) ABSTRACT

A box cover or container is provided which includes a first cellulosic board having dorsal and ventral surfaces, the board including a main panel and four flanking panels, one on each side of the main panel standing in orthogonal relationship to one another thereby forming a tray suitable as a cover or container portion of the box. A second board is placed, preferably in adhesive arrangement, against the ventral surface of the first cellulosic board, the second board having a thickness greater than that of the first cellulosic board. A colored pattern is ordinarily printed on the dorsal surface for decorative purposes. A process and blank to assemble the box cover or container is described. In the process, the number of steps are less than half those required for manufacture of a traditional gift or set box.

8 Claims, 2 Drawing Sheets

GIFT OR SET BOX

This application claims the benefit of provisional application No. 60/211,257 filed on Jul. 13, 2000.

BACKGROUND OF THE INVENTION

1. Field of the Invention

The invention relates to a gift or set box and process for manufacture. Boxes of this invention have use as packaging articles, particularly as gift packages for such items as cosmetics, jewelry, millinery and the like.

2. The Related Art

Gift or set boxes are upscale packaging for many types of goods. They are sturdy and when decorated impart a feeling of class to the packaged merchandise.

The term "gift box" or "set box" refers to a standard identity of construction. Structure of this article is best explained by description of its manufacture process. A boxboard sheet of 50 to 80 gauge is cut to an appropriate size of square or rectangular shape. Four corners are cut out on the sheet. A machine scores inward of the edge lines parallel to outer edges of the shape thereby forming a smaller square or rectangle bordered by skirt panels. Then a mandrel presses against the scored sheet with concomitant folding of the skirt panels along the scorelines to result in a tray configuration. Orthogonally bent skirt panels forming the tray are secured at the respective four corners by plastic or paper adhesive strips known in the industry as stays. The resultant tray can be used as either a cover or container unit of the gift or set box.

For definition purposes, a gift or set box is formed of two units. The bottom unit referred to herein as the container is normally deep and holds articles. The upper unit referred to herein as the cover is relatively shallow and is employed as a lid over the container.

Boxboard cannot easily be printed upon in a fashion to obtain a sharp imaged pattern. Consequently a random pattern printed paper must be cut to the size of the tray as a decorative cover. Glue is applied to the cut printed paper and via a mandrel pressed against the tray. In many instances, the set box requires a label indicating logo, contents such as ingredients or weight and other information. Labels cannot be provided on the random pattern printed paper because registration can never be precise during the placement of printed paper to tray. Therefore, it is necessary to apply a "finding label" as a separate item onto the outer surface of the printed paper decorated tray.

The aforementioned process for the traditional manufacture of gift or set boxes includes about seven steps as outlined above for either of the cover or container units. The process is laborious, relatively inflexible and quite costly. Alternate more cost efficient manufacturing processes would greatly benefit the box industry.

Accordingly, it is an object of the present invention to provide a gift or set box manufacturable with fewer steps than the many required in traditional manufacture of such articles.

Another object of the present invention is to provide a new process for the manufacture of gift or set boxes.

Yet another object of the present invention is to provide an improved gift or set box and related process which is particularly suitable for the cosmetics, millinery and jewelry industries.

SUMMARY OF THE INVENTION

A box cover or container is provided which includes:

(i) a first cellulosic board having a dorsal and a ventral surface, the board including a main panel of rectangular or square shape and four flanking panels, one on each side of the main panel, standing in orthogonal relationship to one another, to the ventral surface and to the main panel thereby forming a tray; and (ii) a second board in juxtaposition and of corresponding shape to the main panel placed against the ventral surface of the first cellulosic board, the second board having a thickness greater than a thickness of the first cellulosic board.

The first cellulosic board is preferably constructed of paperboard having a thickness ranging from about 0.025 mm to about 5 mm but preferably from about 0.25 mm to about 0.75 mm, optimally from about 0.45 mm to about 0.55 mm. Moisture content of the first cellulosic board may range from about 0.2 to about 20%, preferably from about 4 to about 12%, optimally from about 6 to about 8% by weight of the board. The high amount of moisture ensures that the board isn't easily cracked as it is bent or scored. Smoothness is another characteristic of the board and by this term is meant sufficient smoothness to ensure a good uniform reflective surface. This is usually evaluated via a visual inspection using a magnifying glass and low angle illumination. Those skilled in the art understand the level of smoothness required for high definition printing on such surfaces. Consistency of caliper is another criteria for high quality board suitable for the present invention. The consistency of caliper should range within the plus or minus of about 0.25 mm, preferably about 0.025 mm or smaller. This ensures that ink is transferred onto the board in a very uniform thickness.

Alternative or in addition to a highly calendared smooth surface, the first cellulosic board can be overlayed with a foil such as an aluminum foil or a plastic foil formed from a polymer selected from the group consisting of polyolefins, polyethylene terephthalate, polyvinyl chloride, polyacrylate, polyacetate, polyvinyl alcohol or any combination thereof. Most preferred is a metallized Mylar® foil. Gauges of the foil may range from about 0.25 mm to about 0.00025 mm, preferably from about 0.025 to about 0.0025 mm, optimally about 0.00875 mm. Alternatively the first cellulosic board may be coated with a clay to achieve suitable smoothness for printing.

Decorative printing is normally a desirable feature of set boxes and their components. Printing may either be on one or both of the dorsal and ventral surfaces. Inked patterns may either be black or multi-colored. Useful printing processes for the decorative pattern may include lithography, gravure, flexography, letterpress and screen printing. Newer technologies also include thermoprinting, electrophotography and ink-jet printing.

By contrast with the traditional process which requires separate placement of finding labels, any labels according to the present invention can be directly printed onto the first cellulosic board. This avoids the traditional problem of registering the labels to properly position them on the main or flanking panels.

According to the present invention there is also provided a process for manufacturing a box cover or container including:

(i) providing a cellulosic board blank having a dorsal and a ventral surface, the blank including a main panel of rectangular or square shape and four flanking panels, one on each side of the main panel;

(ii) folding the flanking panels of the blank inward toward the ventral surface to form a tray, the flanking panels standing orthogonal to the ventral surface of the cellulosic board blank and defining with the ventral surface a receiving area;

(iii) placing a second board in juxtaposition to the receiving area, an adhesive being located between a surface of the second board and the ventral surface; and (iv) applying pressure to the second board and ventral surface to achieve joinder therebetween.

Ordinarily the second board is sized to exactly fit the receiving area. The second board will have a thickness greater than that of the cellulosic board blank. In an alternative manner the second board can be placed on the ventral surface of the cellulosic board blank either before or after the flanking panels are folded into walls to define a tray. Suitable thicknesses for the second board may range from about 1 mm to about 100 mm, preferably from about 8 mm to about 50 mm.

Optionally steam can be shot onto all four flanking panels to eliminate memory. Bowing is avoided by the application of moisture (along with pressure/heat) with further benefit of keeping the flanking panels straight. Gussetted webs at each of the four corners also contribute to enhancing rigidity at the corners of the tray. Gussetted edges have the further benefit of avoiding the aesthetically displeasing view of a white (cut) edge.

The addition of a second board having greater thickness than the cellulosic board blank lends weight and strength to the box while minimizing the necessity of having all panels and components of the same heavy gauge. By avoidance of heavy gauge board box, a more economical process with less material can achieve the same functional result. This contrasts with the traditional process of employing a sheet of board box (50–80 gram) which first must be cut on each of the four corners to eliminate an area (by contrast to using gussetted edges). Next a machine needs to score the flanking panels. A mandrel must then engage the flanking panels to fold them orthogonal to a central area of the board box. Stays (plastic/paper adhesive strips) are placed along each of the four corners to hold upright the flanking panels. Decorative paper must be prepared in a separate procedure. Random patterned printed paper (on one side) is cut to the size of the tray. Adhesive is then applied to the cut printed paper via another mandrel and the paper fitted over the tray. Finally a finding label is placed on an outer surface of the patterned printed paper (the step being necessary for lack of registration of the pattern printed paper relative to the board box). These steps are more than double those required by the present inventive process.

BRIEF DESCRIPTION OF THE DRAWING

Further objects, advantages and features of the present invention will become more readily apparent through consideration of the following drawing in which.

DETAILED DESCRIPTION OF THE INVENTION

Now we have developed an improved set box and manufacturing process. The box exhibits the rigidity/strength of the traditional article yet is lighter weight and can be manufactured in a much more cost efficient manner. Unlike traditional set boxes, those of the present invention do not employ a thick boxboard or require a separate decorative stock to be cut and pasted over the boxboard with its attendant manufacturing inefficiencies. By the present invention a much lighter weight paperboard (also known as carton board) is utilized which can be inked to form a decorative sharp pattern on the board itself. Only a small amount of thick board box need be glued to the decorated underside of the paperboard to achieve structural sturdiness.

Figure 1:
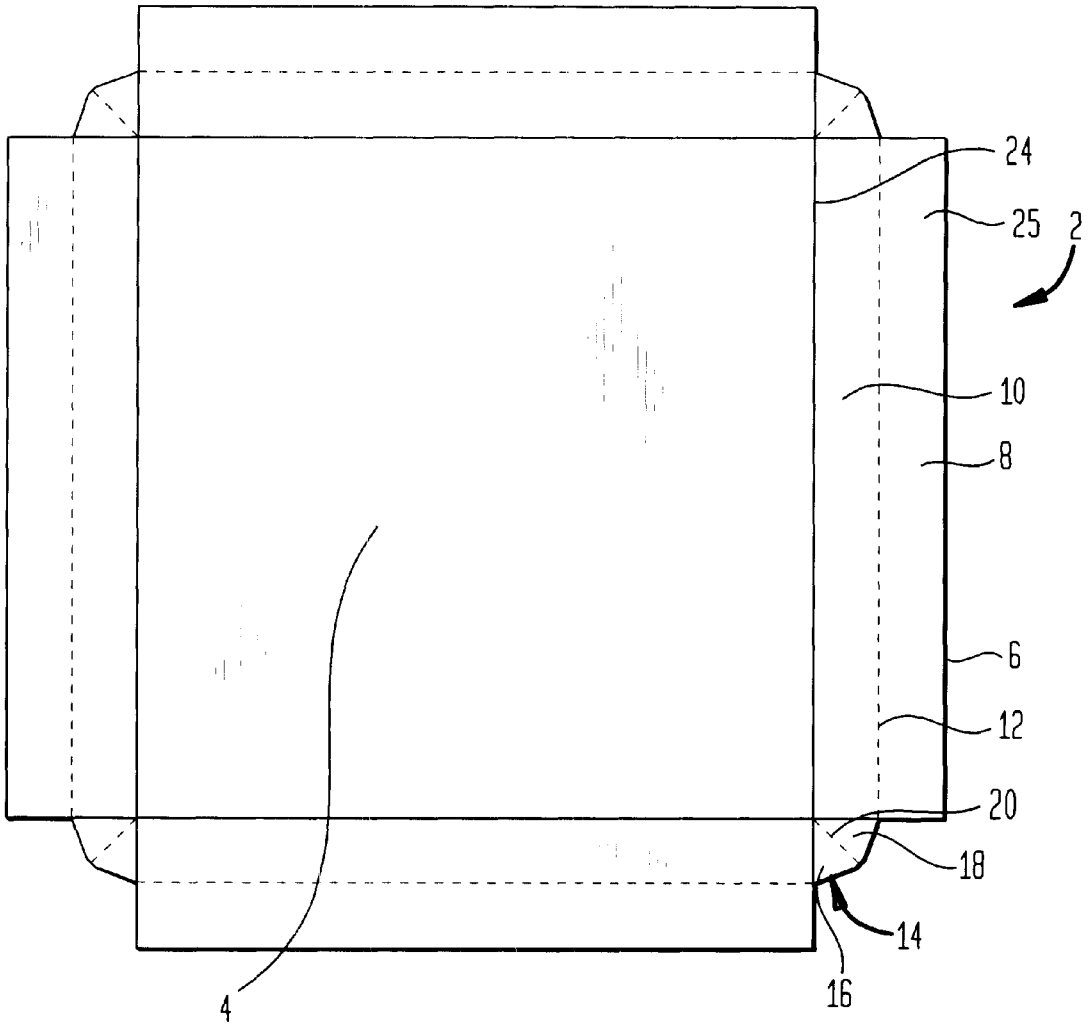
FIG. 1 is a top plan view of a blank foldable into a set box cover or container according to the present invention.

FIG. 1 illustrates a blank formed of a first cellulosic board 2 including a main panel 4 surrounded on four sides with respective flanking panels 6. Each of the flanking panels 6 includes an exterior flap 8 and an interior flap 10 separated by a fold line 12. On each of the corners is a gussetted web 14 formed by a pair of triangular wings 16, 18 separated by a perforated line 20. Gussetted web 14 along edges of the wings is joined to a pair of adjacent interior flaps 10.

Figure 2:
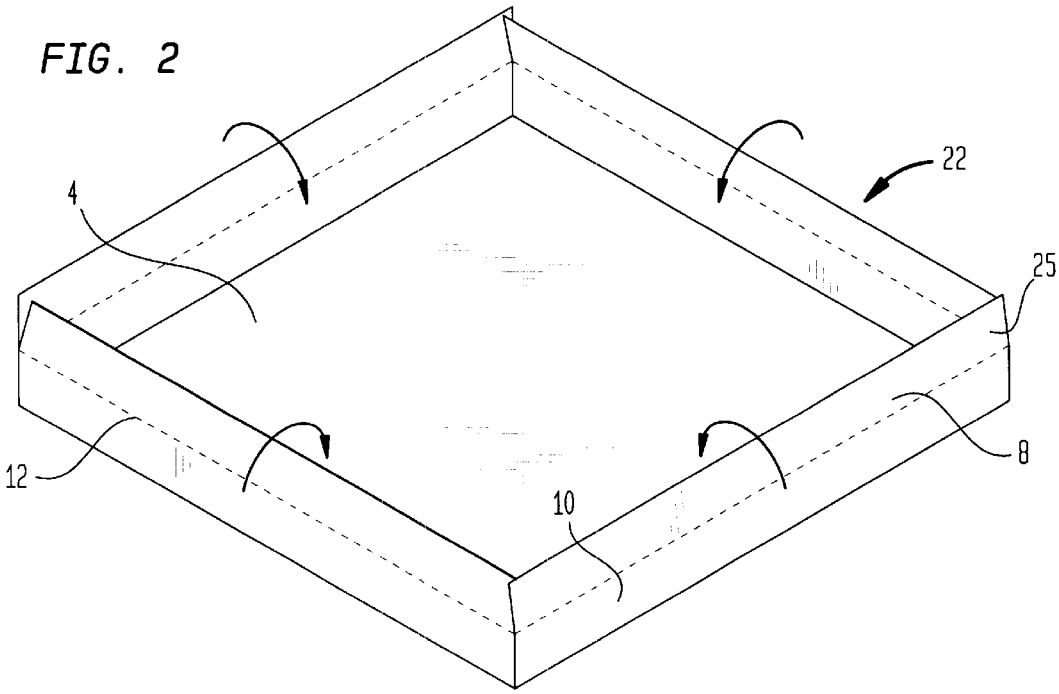
FIG. 2 is an elevational view of the set box blank of FIG. 1 with the flanking panels being bent in partial completion of a box tray.

FIG. 2 illustrates a partially complete build of the blank into a tray 22. Construction of the tray begins by bending each of the flanking panels 6 inward along crease lines 24. Movement of the flanking panels forces concurrent movement of the gussetted webs 14 inward with bending forcing the triangular wings 16, 18 to pivot along perforated line 20.

Figure 3:
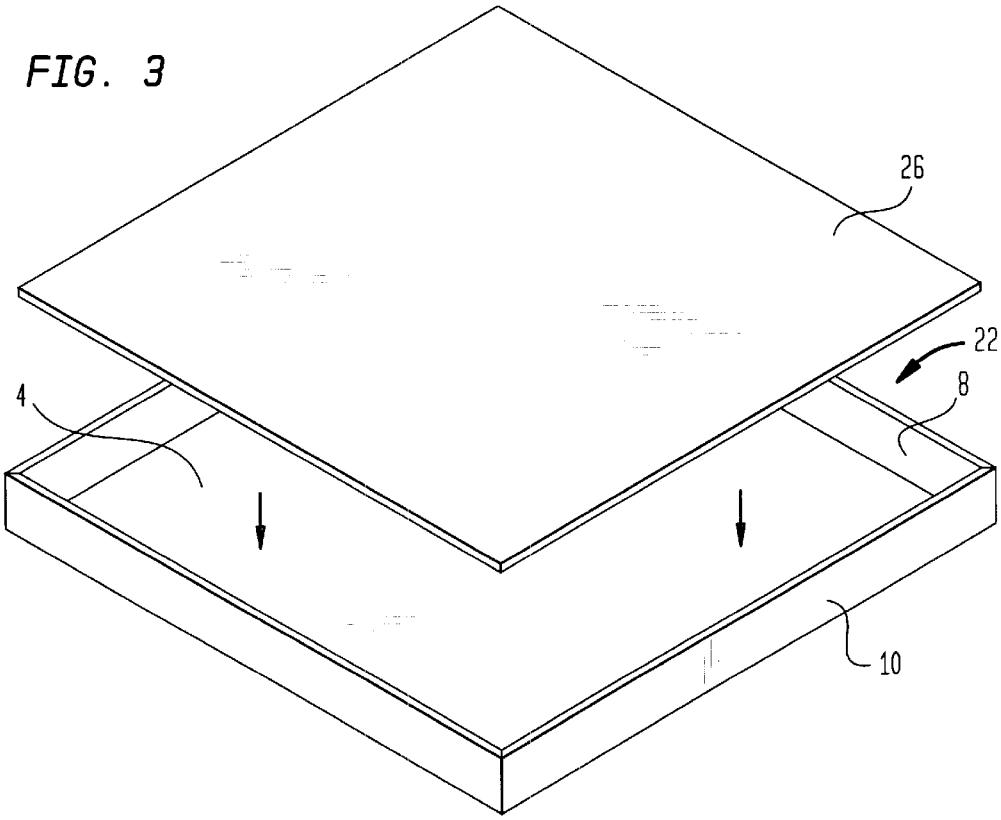
FIG. 3 is a perspective view of the blank according to FIG. 1 being fully folded into the tray with the second board being positioned for adhesive attachment over a ventral surface of the cellulosic board now formed into a tray.

FIG. 3 illustrates completion of folding construction for the first cellulosic board 2 into tray 22. Each pair of exterior flaps 8 on opposite sides of the blank are folded inward along their respective fold line 12. End areas 25 of the exterior flaps 8 are folded in a manner to overlay triangular wings 16, 18. Thereafter the other pair of opposed exterior flaps 8 are folded inward along their respective fold lines 12.

FIG. 3 illustrates the final construction step. A second board 26 having dimensions substantially identical to that of the main panel 4 is pressed against an inner surface of the main panel. Just prior to this step, an adhesive may be applied to either or both of the adjoining surfaces of the main panel and second board. A mandrel with forming heads may simultaneously apply glue and pressure to insure a strong bond between the second board and the main panel.

Except in the operating and comparative examples, or where otherwise explicitly indicated, all numbers in this description indicating dimensions of materials ought to be understood as modified by the word "about".

The foregoing description and examples illustrate selected embodiments of the present invention. In light thereof variations and modifications will be suggested to one skilled in the art, all of which are within the spirit and purview of this invention.

What is claimed is:

1. A box cover or container comprising:

(i) a first cellulosic board having a dorsal and a ventral surface, the board including a main panel of rectangular or square shape and four flanking panels, one on each side of the main panel, standing in orthogonal relationship to one another, to the ventral surface and to the main panel thereby forming a tray; and (ii) a second board in juxtaposition and of corresponding shape to the main panel placed against the ventral surface of the first cellulosic board, the second board having a thickness greater than a thickness of the first cellulosic board, the first and second cellulosic boards being adhesively attached to one another, the second board not being unitarily formed with a blank forming the first cellulosic board, and the second board not having side panels unitarily formed with said second board.

2. The box cover or container according to claim 1 wherein at least one side of the first cellulosic board is sufficiently smooth for printing and is imprinted with a colored pattern.

3. The box cover or container according to claim 1 wherein the first cellulosic board has a thickness ranging from about 0.025 mm to about 5 mm.

4. The box cover or container according to claim 1 wherein the second board has a thickness ranging from about 1 mm to about 100 mm.

5. The box cover or container according to claim 1 further comprising a gussetted web adjacent pairs of said flanking panels.

6. The box cover or container according to claim 1 wherein each of the flanking panels comprises an exterior flap and an interior flap separated from one another by a fold line, the exterior and interior flaps being folded along the fold line to lie adjacently parallel to one another.

7. The box cover or container according to claim 6 wherein the exterior and interior flaps of all the four flanking panels are all identical in width.

8. A blank for a box cover or container comprising:

a first cellulosic board having dorsal and ventral surfaces, the dorsal surface being printed with a decorative pattern, the board comprising a main panel having four sides, a flanking panel being attached to each of the sides and a gussetted web joining adjacent flanking panels at each corner of the main panel, the gussetted web comprising a pair of triangular wings separated by a perforated line allowing the wings to move inwardly toward one another in a folding operation, and a second board adhesively attached in juxtaposition and of corresponding shape to the main panel.

* * * * *